US008613317B2

(12) United States Patent
Briquet et al.

(10) Patent No.: US 8,613,317 B2
(45) Date of Patent: Dec. 24, 2013

(54) DOWNHOLE PISTON PUMP AND METHOD OF OPERATION

(75) Inventors: Stephane Briquet, Houston, TX (US); Mark Milkovisch, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 429 days.

(21) Appl. No.: 12/611,575

(22) Filed: Nov. 3, 2009

(65) Prior Publication Data

US 2011/0100641 A1 May 5, 2011

(51) Int. Cl.
*E21B 47/00* (2012.01)

(52) U.S. Cl.
USPC ..... 166/264

(58) Field of Classification Search
USPC ..... 166/264; 417/53, 375, 378
See application file for complete search history.

(56) References Cited

U.S. PATENT DOCUMENTS 3,934,468 A 1/1976 Brieger
4,403,919 A * 9/1983 Stanton et al. ..... 417/53
4,860,581 A 8/1989 Zimmerman et al.
4,893,505 A 1/1990 Marsden et al.
4,936,139 A 6/1990 Zimmerman et al.
5,303,775 A 4/1994 Michaels et al.
5,622,223 A 4/1997 Vasquez
5,984,140 A * 11/1999 Amron ..... 222/79
6,582,205 B2 * 6/2003 Batten et al. ..... 417/393
7,124,819 B2 * 10/2006 Ciglenec et al. ..... 166/264
7,302,966 B2 12/2007 Brennan, III et al.
7,387,061 B2 * 6/2008 Kobata et al. ..... 91/405
7,527,070 B2 5/2009 Brennan, III et al.
2008/0053212 A1 3/2008 Brennan, III et al.

* cited by examiner

*Primary Examiner* — Giovanna Wright
*Assistant Examiner* — Kipp Wallace
(74) *Attorney, Agent, or Firm* — Cathy Hewitt; John Vereb

(57) ABSTRACT

A method, according to one or more aspects of the present disclosure, for operating a positive displacement pump of a downhole tool comprises supplying a hydraulic pressure to the pump to actuate a two-stroke piston to displace fluid at least partially through the downhole tool; moving the piston in a first stroke direction; and reversing the direction of the piston upon completion of the first stroke of the piston. Completion of a stroke may comprise a head of the piston substantially abutting an end wall of a chamber of the pump.

20 Claims, 9 Drawing Sheets

DOWNHOLE PISTON PUMP AND METHOD OF OPERATION

BACKGROUND OF THE DISCLOSURE

This section of this document is intended to introduce various aspects of the art that may be related to various aspects of the present disclosure described and/or claimed below. This section provides background information to facilitate a better understanding of the various aspects of the present disclosure. That such art is related in no way implies that it is prior art. The related art may or may not be prior art. It should therefore be understood that the statements in this section of this document are to be read in this light, and not as admissions of prior art.

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation permeability. These measurements are essential to predicting the production capacity and production lifetime of a subsurface formation.

One technique for measuring formation and reservoir fluid properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include a probe that may be pressed against the wellbore wall to establish fluid communication with the formation. This type of wireline tool is often called a "formation tester." Using the probe, a formation tester measures the pressure of the formation fluids, generates a pressure pulse, which is used to determine the formation permeability. The formation tester tool also typically withdraws a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip" uphole. Further, the wireline tools must be lowered to the zone of interest, commonly at or near the bottom of the wellbore. A combination of removing the drill string and lowering the wireline tools downhole are time-consuming measures and can take up to several hours, depending upon the depth of the wellbore. Because of the great expense and rig time required to "trip" the drill pipe and lower the wireline tools down the wellbore, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223, which are incorporated herein by reference.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling). A variety of downhold MWD and LWD drilling tools are commercially available. Further, formation measurements can be made in tool strings which do not have a drill bit but which may circulate mud in the borehole.

MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, facilitates making decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

Formation evaluation tools capable of performing various downhole formation tests typically include a small probe and/or pair of packers that can be extended from a drill collar to establish hydraulic coupling between the formation and sensors and/or sample chambers in the tool. Some existing tools use a pump to actively draw a fluid sample out of the formation so that it may be stored in a sample chamber in the tool for later analysis.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1A:
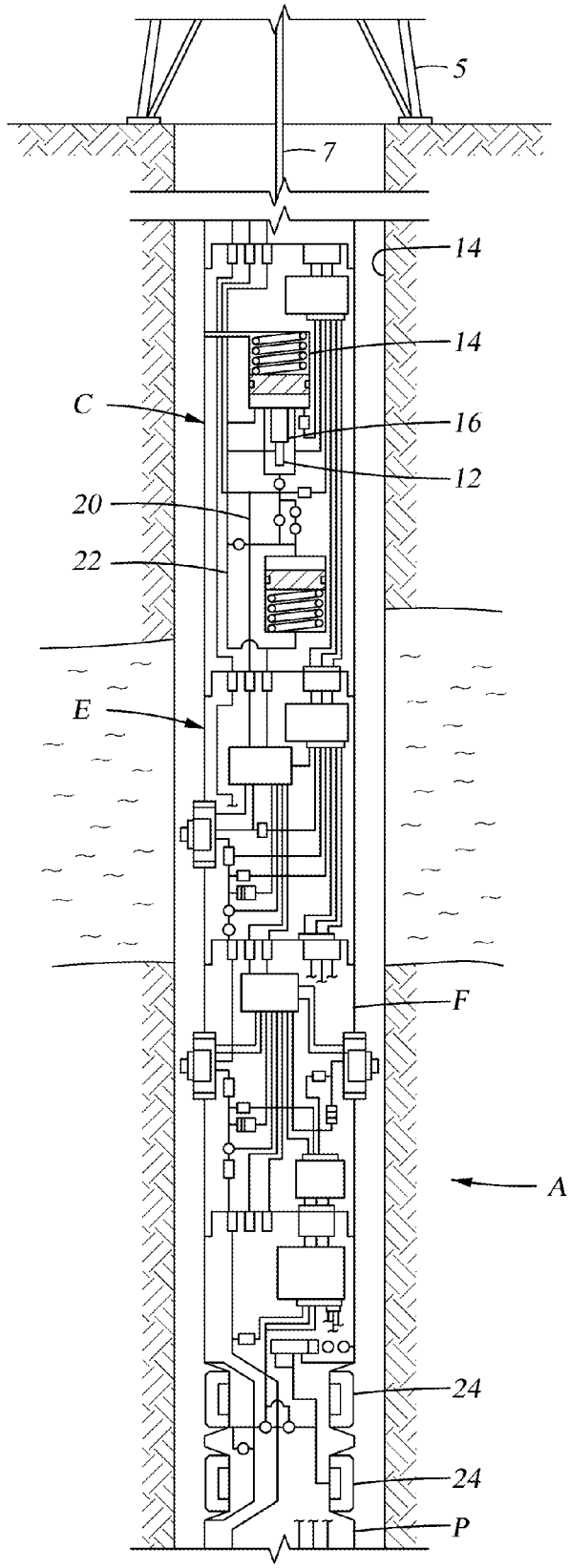
FIGS. 1A, 1B are schematic views of a downhole apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Those skilled in the art, given the benefit of this disclosure, will appreciate that the disclosed apparatuses and methods have applications in operations other than drilling and that drilling is not necessary to one or more aspects of the present disclosure. While this disclosure is described in relation to sampling, the disclosed apparatus and method may be applied to other operations including injection techniques.

The phrase "formation evaluation while drilling" refers to various sampling and testing operations that may be performed during the drilling process, such as sample collection, fluid pump out, pretests, pressure tests, fluid analysis, and resistivity tests, among others. It is noted that "formation evaluation while drilling" does not necessarily mean that the measurements are made while the drill bit is actually cutting through the formation. For example, sample collection and pump out are usually performed during brief stops in the drilling process. That is, the rotation of the drill bit is briefly stopped so that the measurements may be made. Drilling may continue once the measurements are made. Even in embodiments where measurements are only made after drilling is stopped, the measurements may still be made without having to trip the drill string.

In this disclosure, "hydraulically coupled" or "hydraulically connected" and similar terms, may be used to describe bodies that are connected in such a way that fluid pressure may be transmitted between and among the connected items. The term "in fluid communication" is used to describe bodies that are connected in such a way that fluid can flow between and among the connected items. It is noted that hydraulically coupled or connected may include certain arrangements where fluid may not flow between the items, but the fluid pressure may nonetheless be transmitted. Thus, fluid communication is a subset of hydraulically coupled.

Figure 1B:
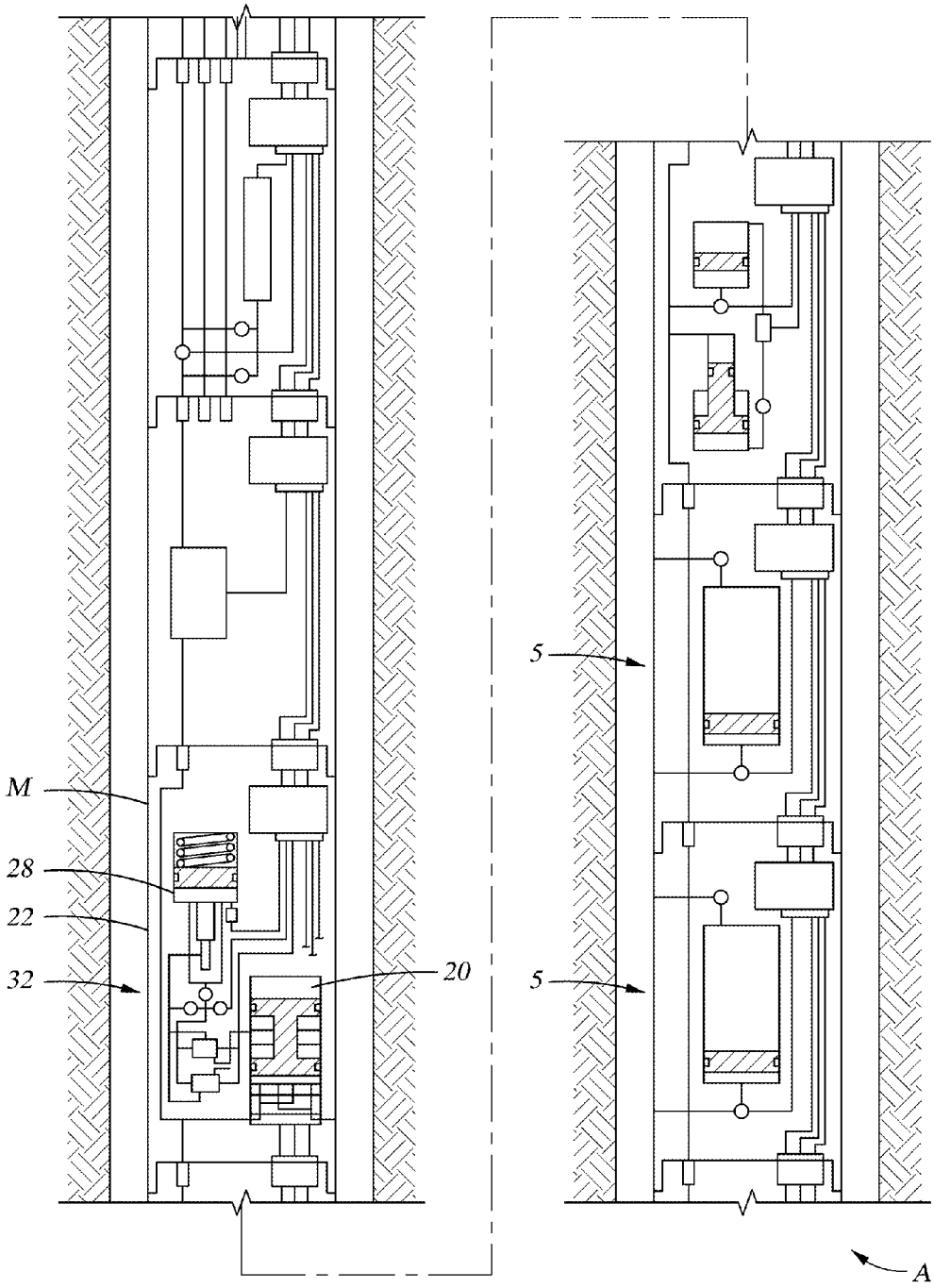

FIGS. 1A and 1B are schematics of a downhole tool A according to one or more aspects of the present disclosure. Tool A is depicted suspended from a rig 5 by a wireline 7 and lowered into a borehole 10 (e.g., wellbore) for the purpose of evaluating formation I. Details related to various aspects of tool A according to one or more aspects of the present disclosure are described in U.S. Pat. Nos. 7,527,070; 7,302,966; 5,303,775; 4,936,139 and 4,860,581, the entire contents of which are hereby incorporated by reference.

Downhole tool A has a hydraulic power module C, probe modules E and/or F, a pump-out module M and a packer module P. Hydraulic power module C includes a pump 12, a reservoir 14 and a motor 16 to control the operation of pump 12. A hydraulic fluid line 20 is connected to the discharge of pump 12 and runs through hydraulic power module C and into adjacent modules for use as a hydraulic power source. Depicted in FIG. 1A, hydraulic fluid line 20 extends through the hydraulic power module C into the probe modules E and/or F depending upon which configuration is used. The hydraulic loop is closed by virtue of the hydraulic fluid return line 22, which in FIG. 1A extends from the probe module E back to the hydraulic power module C where it terminates at the reservoir 14.

Pump-out module M, depicted in FIG. 1B, comprises a pump assembly 32 having a positive displacement, two-stroke piston pump 26 (e.g., displacement unit) energized by hydraulic fluid from a pump 28. Pump-out module M may be used to dispose of unwanted fluid samples by virtue of pumping fluid through a flow line 22 into the borehole, or may be used to pump fluids from borehole 10 into flow line 22 to inflate the straddle packers 24 (FIG. 1A). Furthermore, pump-out module M may be used to draw formation fluid from the borehole via the probe module E or F, and pump the formation fluid into the sample chamber module S against a buffer fluid therein. In other words, pump-out module M is useful for pumping fluids into, out of, and (axially) through downhole tool A.

Figure 2A:
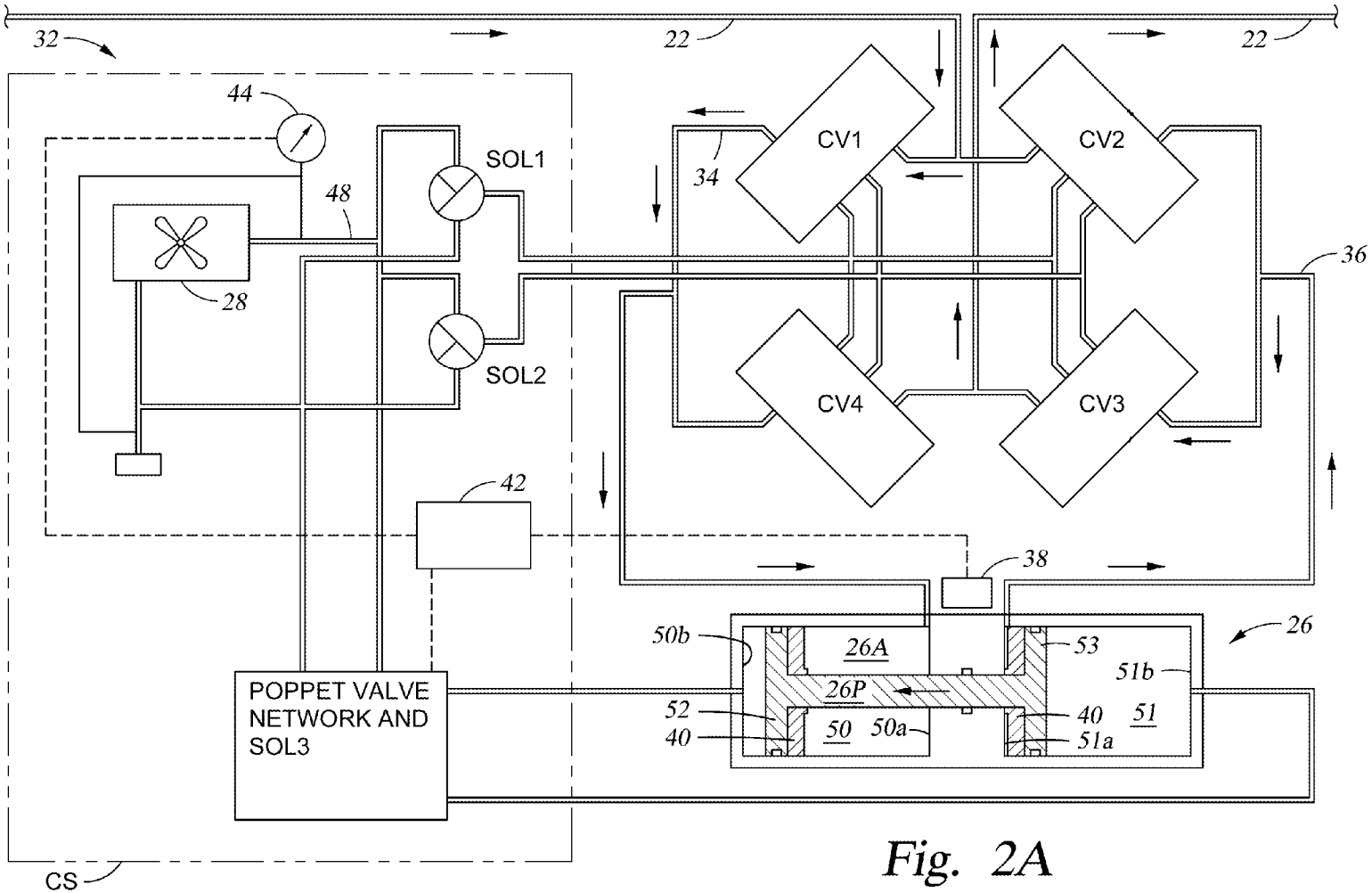
FIGS. 2A, 2B are schematic views of a fluid pumping module according to one or more aspects of the present disclosure.
Figure 2B:
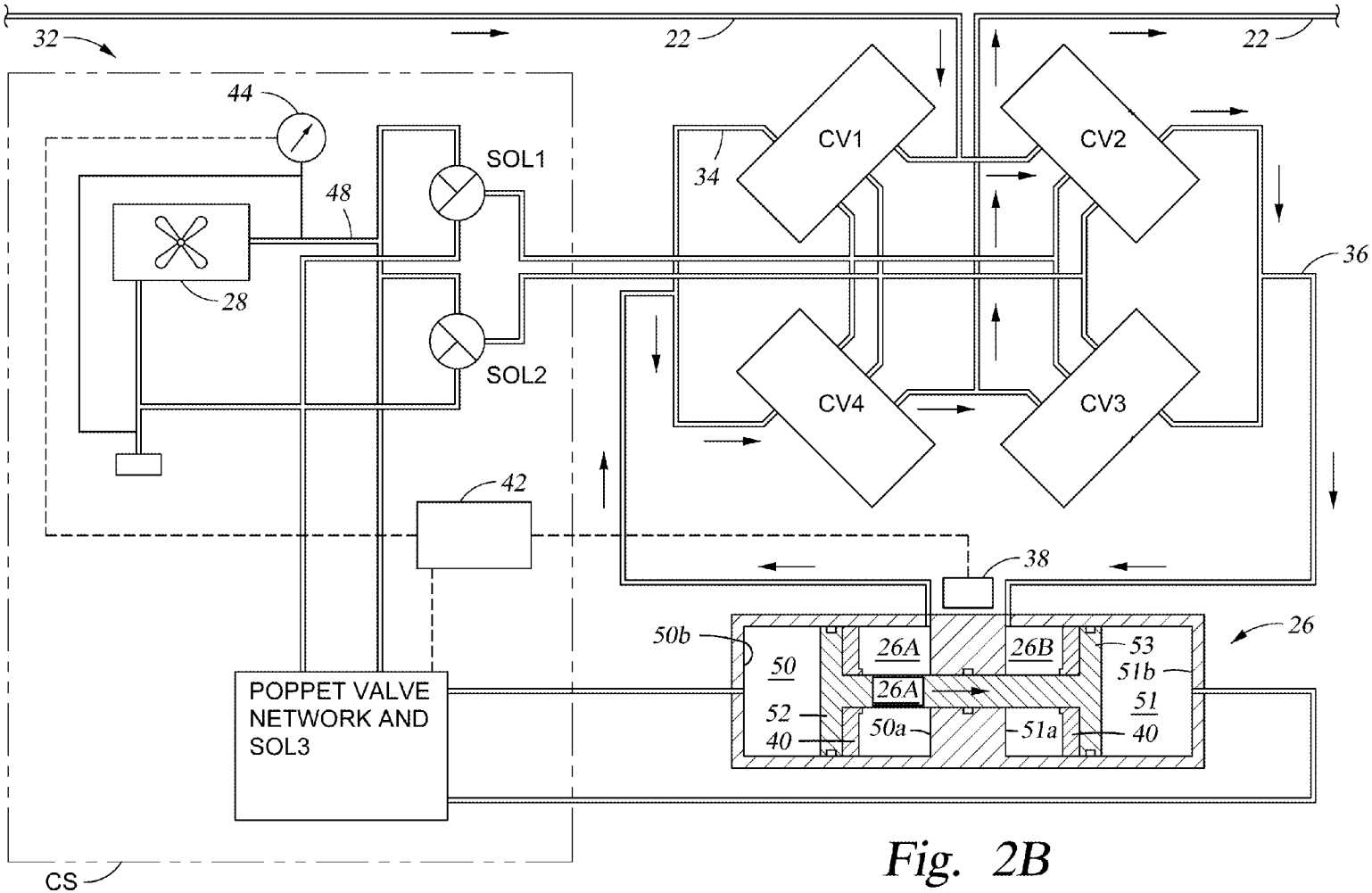

FIGS. 2A-B are schematic illustrations of a pump assembly 32 employing control valve settings and flow directions according to first and second respective strokes of a two-stroke piston "pump-up" cycle according to one or more aspects of the present disclosure. Assembly 32 of FIGS. 2A, 2B may be used, e.g., for pumping fluid at least partially through downhole tool A (see FIGS. 1A, 1B). Such pumping may include drawing fluid into tool A, discharging fluid from the tool, and/or moving fluid from one location to another location within the tool, as are well know in the related art.

Depicted pump assembly 32 includes a first flow line 34 equipped with a pair of control valves CV1, CV4 for selectively communicating fluid to or from displacement unit 26 and a second flow line 36 equipped with a pair of control valves CV2, CV3 for selectively communicating fluid to or from displacement unit 26. Hydraulic fluid is directed by hydraulic pump 28 through solenoids SOL1 and SOL2, which form part of a control system CS for assembly 32, to control the operation of valves CV1-CV4. Control valves CV1-CV4 may be passive valves (e.g., check valves) or active valves. In an active system, control valves CV1-CV4 are operated between open and closed positions, for example via control system CS and solenoids SOL1 and SOL2. In a passive system, solenoids SOL1 and SOL2 may be utilized for example to shift check slides to set the bias of the check valve CV1-CV4. Passive valves ensure that fluid flows through the control valves when the direction (e.g., stroke) of piston 26P reverses. A sufficient fluid-flowing pressure must be available in lines 34 and 36 to overcome the biasing force of the respective passive control valves CV1-CV4. SOL3 and the associated poppet valve network is provided to reciprocate central hydraulic piston 26P of displacement unit 26.

Control system CS may include sensor(s) 38 (e.g., Hall Effect sensor) to detect the position of piston 26P, e.g., magnets 40 (or, alternatively, simply detect when the piston 26P approaches the end of its stroke), and system electronics 42 that automatically command the solenoids to selectively deliver hydraulic fluid via pump 28 to achieve the proper settings for control valves CV1-CV4. Thus, control system CS is operable to synchronize the operation of displacement unit 26 with the control valves, such that each control valve is commanded to open or close (e.g., active control valves) or biased for flow in a desired direction (e.g., passive) at or near the time that pump piston 26P completes each of its two strokes. A drawback of prior art displacement units is the failure of piston 26P to complete a stroke resulting in "dead volume" in chambers 26A, 26B of displacement unit 26. For example, in prior art systems, sensor(s) 38 detect piston 26P (e.g., magnet(s) 40) approaching the abutting end of chambers 26A, 26B and electronic system 42 operates SOL3 to drive piston 26P in the opposite direction. To effect the piston direction reversal, piston 26P does not abut against the end of the pump chamber resulting in a dead volume.

According to one or more aspects of the present disclosure, pump assembly 32 may include a gauge 44 (e.g., sensor) in communication with electronic controller 42 and energizing pump 28 to detect the end of the stroke of piston 26P and to actuate SOL3 to reverse the stroke direction of piston 26P. Depicted gauge 44 is hydraulically coupled to the hydraulic circuit 48 (e.g., flow line) that provides the hydraulic fluid from pump 28 to energize displacement unit 26.

In the "pump-up" setting depicted in FIGS. 2A-B, fluid is moved to the right in flow line 22 by through control valves CV1, CV3 in respective flow lines 34, 36 during the first stroke (piston 26P moves left in FIG. 2A). Such fluid movement is continued during the second stroke (piston 26P moves right in FIG. 2B) by through control valves CV2, CV4 in respective flow lines 36, 34. The direction of the stroke of piston 26P is controlled via SOL3 and electronic controller 42 in the depicted embodiment. As piston 26P of displacement unit 26 bottoms out, the pressure in hydraulic circuit 48 increases.

Figure 3:
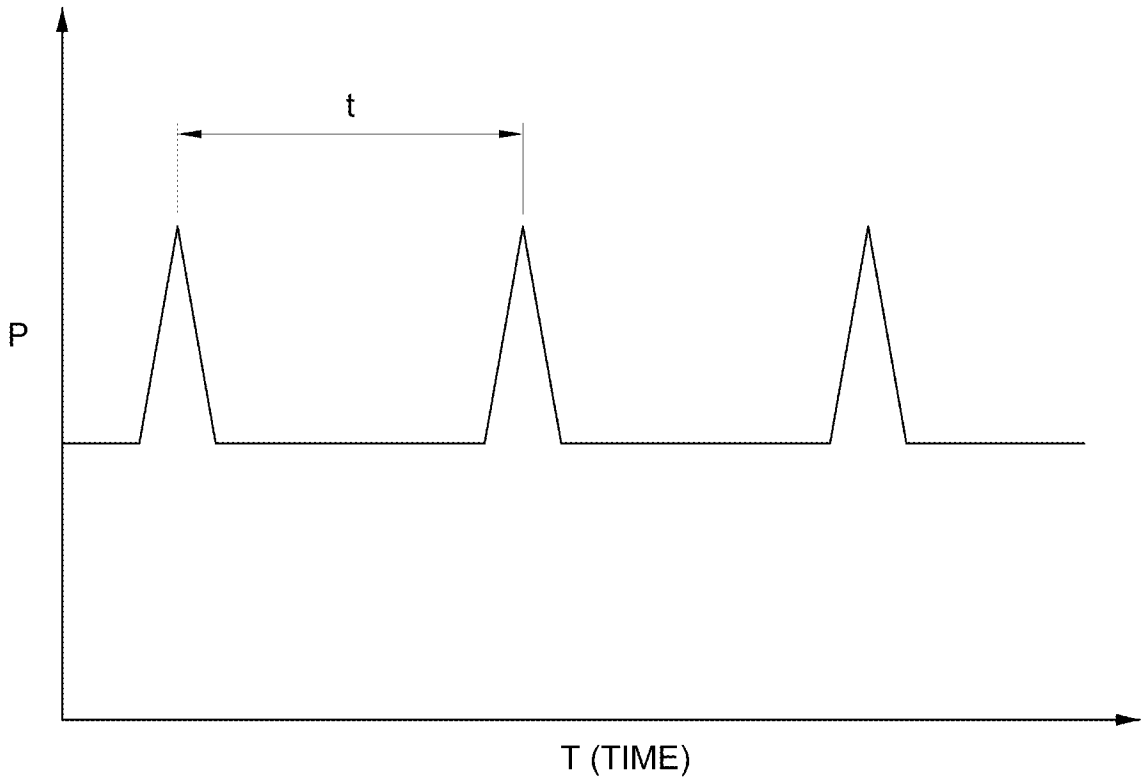
FIG. 3 is a graphical depiction according to one or more aspects of the present disclosure.

FIG. 3 is a graphical depiction of operation of pump assembly 32 according to one or more aspects of the present disclosure. FIG. 3 depicts a pressure trace in hydraulic circuit 48. As piston 26P of displacement unit 26 bottoms out, the pressure (e.g., energy) to drive piston 26P increases (measured for example via gauge 44). When a threshold pressure increase is detected (e.g., via electronic controller 42) the control valves CV1-CV4 (e.g., mud valves) may be switched (e.g., opening and closing active control valves, or biasing passive control valves). Switching of control valves CV1-CV4 is facilitated by the high pressure in hydraulic circuit 48. SOL3, and the associated poppet valves, may be actuated (e.g., electronic controller 42) to change the state of the poppet valves and reverse the direction of piston 26P. A threshold value for detection of the pressure increase may be associated with the relief pressure threshold of the control valves. An average flow rate during the stroke of piston 26P may be obtained by measuring the time interval between peaks and dividing the known complete stroke volume by the time interval. According to one or more aspects to the present disclosure, shifting of the direction of piston 26P may be made based on the pressure associated with energizing displacement unit 26 and without reference to the determination of the position of piston 26P based on sensor 38.

According to one or more aspects of the present disclosure, it may be desired to slow the speed of piston 26P as it reaches the end of a stroke. In other words, it may be desired to reduce or eliminate the high impact of piston 26P with the end of a chamber 26A, 26B that may be associated with providing a full stroke (e.g., bottoming out) of piston 26P. Additionally, smoothing out the rate (e.g., reducing or eliminating pressure spikes) at which fluid is pumped from formation I (FIG. 1A) may improve formation fluid pumping. The flow rate generated as a function of time may look like a "rectified-sine" type of signal versus time rather than "square." The flow rate, as previously described with reference to FIG. 3, may be more representative of the time varying pumping flow rate prescribed to the formation.

A full stroke is used herein to mean that piston 26P travels a distance sufficient so that the head of piston 26P that is disposed within a particular chamber 26A, 26B contacts or substantially abuts the end wall defining chamber 26A, 26B. Referring to FIG. 2B, displacement unit 26 comprises a first cylinder 50 and a second cylinder 51. First cylinder 50 is formed between an end wall 50*a* and a distal wall 50*b*. Similarly, second cylinder 51 is formed between an end wall 51*a* and a distal wall 51*b*. Piston 26P comprises a first head 52 disposed in first cylinder 50 and a second head 53 disposed in second cylinder 51. First chamber 26A is formed between piston head 52 and end wall 50*a* and second chamber 26B is formed between piston head 53 and end wall 51*a*. Each piston head may include features such as magnets 40 and the like. In FIG. 2B, a stroke of piston 26P is completed when piston head 52 abuts or substantially abuts end wall 50*a*. Referring to FIG. 2A, piston 26P is moving from right to left and is bottoming out as piston head 53 abuts end wall 51*a*. At this point, pressure in hydraulic circuit 48 as indicated by gauge 44 is peaking (FIG. 3) and electronic controller 42 is actuating SOL3 to reverse the stroke direction of piston 26P (FIG. 4B).

Figure 4A:
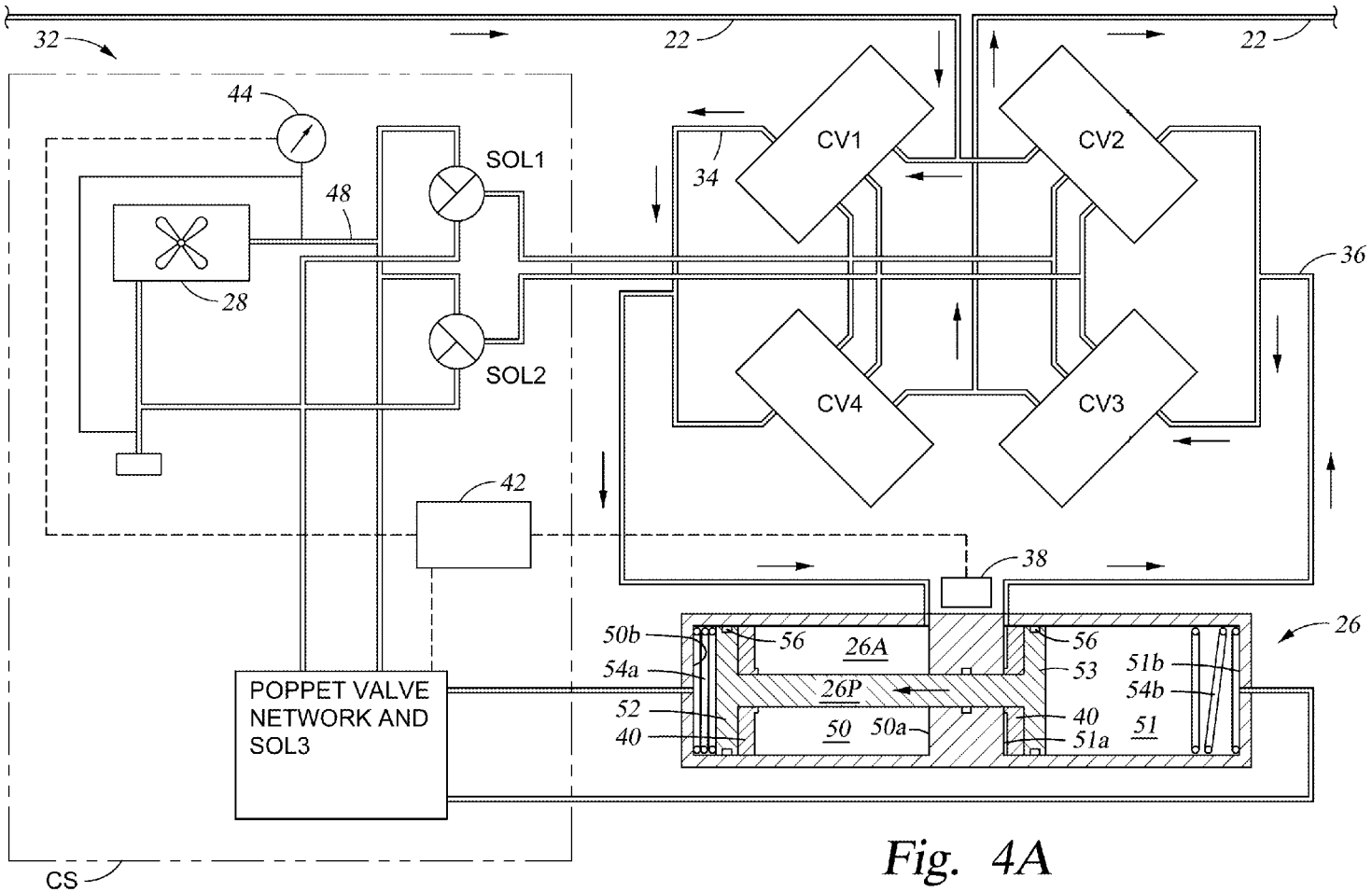
FIGS. 4A, 4B are schematic views of a fluid pumping module according to one or more aspects of the present disclosure.
Figure 4B:
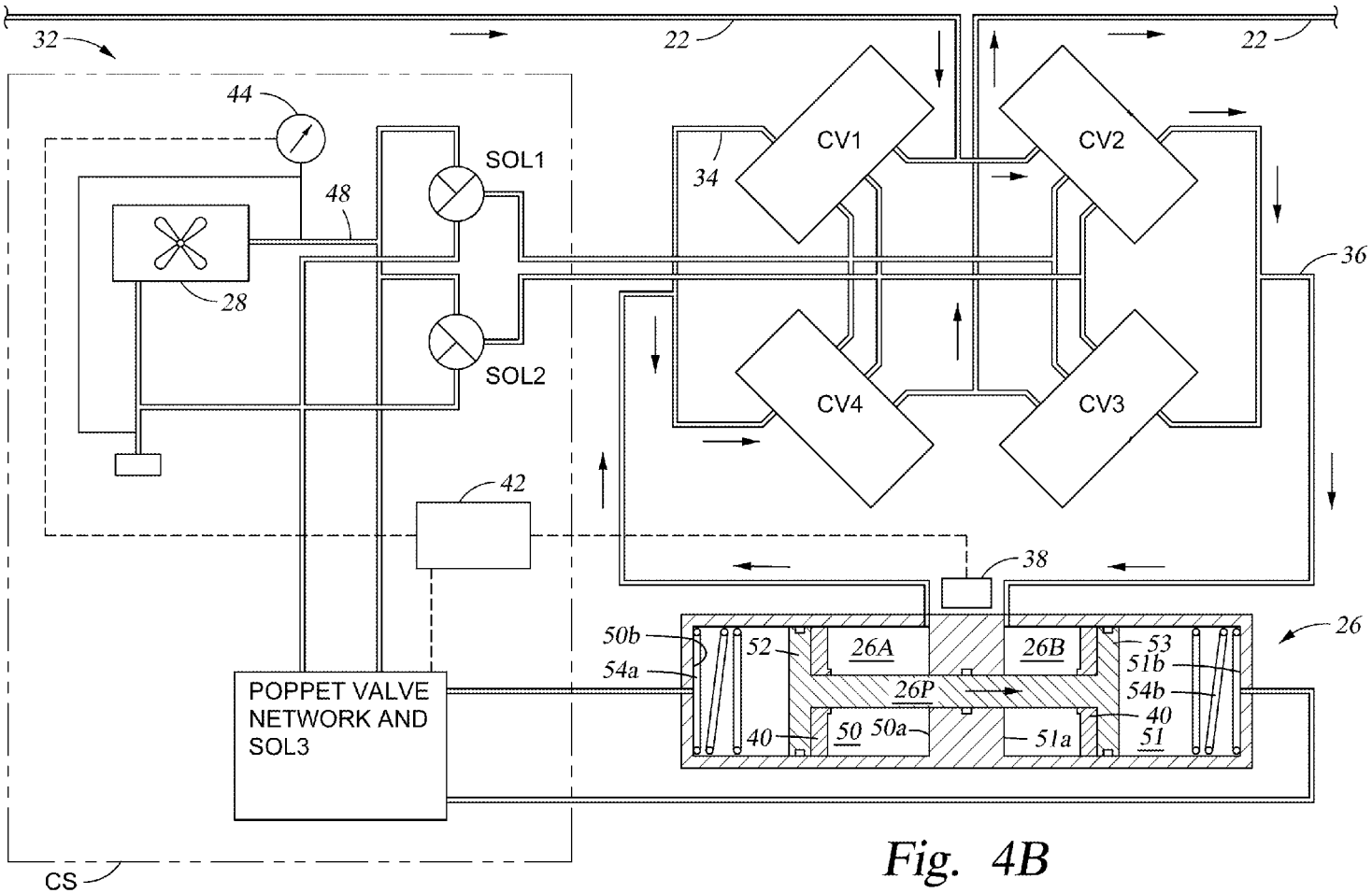

FIGS. 4A, 4B are schematic illustrations of a pump assembly 32 according to one or more aspects of the present disclosure. Pump assembly 32 depicted in FIGS. 4A, 4B is adapted to mitigate and/or dampen the shock (e.g., impact) of piston 26P reaching the end of its stroke (e.g., bottoming out). Pump assembly 32 depicted in FIGS. 4A, 4B includes a dampening device, generally denoted by the numeral 54, disposed with displacement unit 26. According to one or more aspects of the present disclosure, dampening device 54 comprises one or more devices identified individually as 54*a* and 54*b*. In this embodiment, first dampening device 54*a* is disposed in cylinder 50 between piston head 52 and distal wall 50*b*. Similarly, a second dampening device 54*b* is disposed in cylinder 51 between distal wall 51*b* and piston head 53. Dampening device 54 is adapted to absorb energy from piston 26P as it approached completion of a stroke. The energy absorbed by dampening device 54 may also be realized in the pressure peaks as depicted in FIG. 3. Referring to FIG. 4A, piston 26P is stroking from right to left as it completes a stroke. Dampening device 54*a*, depicted as a spring in FIGS. 4A, 4B, has been compressed by piston head 52 against distal wall 50*b* absorbing energy from piston 26P and slowing its speed as it completes a stroke. Dampening device 54 may comprise various apparatus, materials and assemblies for dampening the impact of piston 26P as it completes a stroke. Examples of dampening devices 54 include, without limitation, springs compressible fluids and pressurized (e.g., hydraulic, pneumatic) cylinders and the like.

Dampening device 54 may improve the pumping efficiency of displacement unit 26. For example, when the piston direction is reversed the force absorbed by device 54 is released to urge piston 26P in the direction of the reverse stroke. The additional energy provided may cause piston 26P to move almost instantaneous when SOL2 (and SOL1 and SOL2) are switched rather than waiting for hydraulic pressure to build for example to overcome friction at seals 56. The quicker reaction time reduces dead time in the pumping cycle thereby increasing the pump flow rate and efficiency.

Figure 5A:
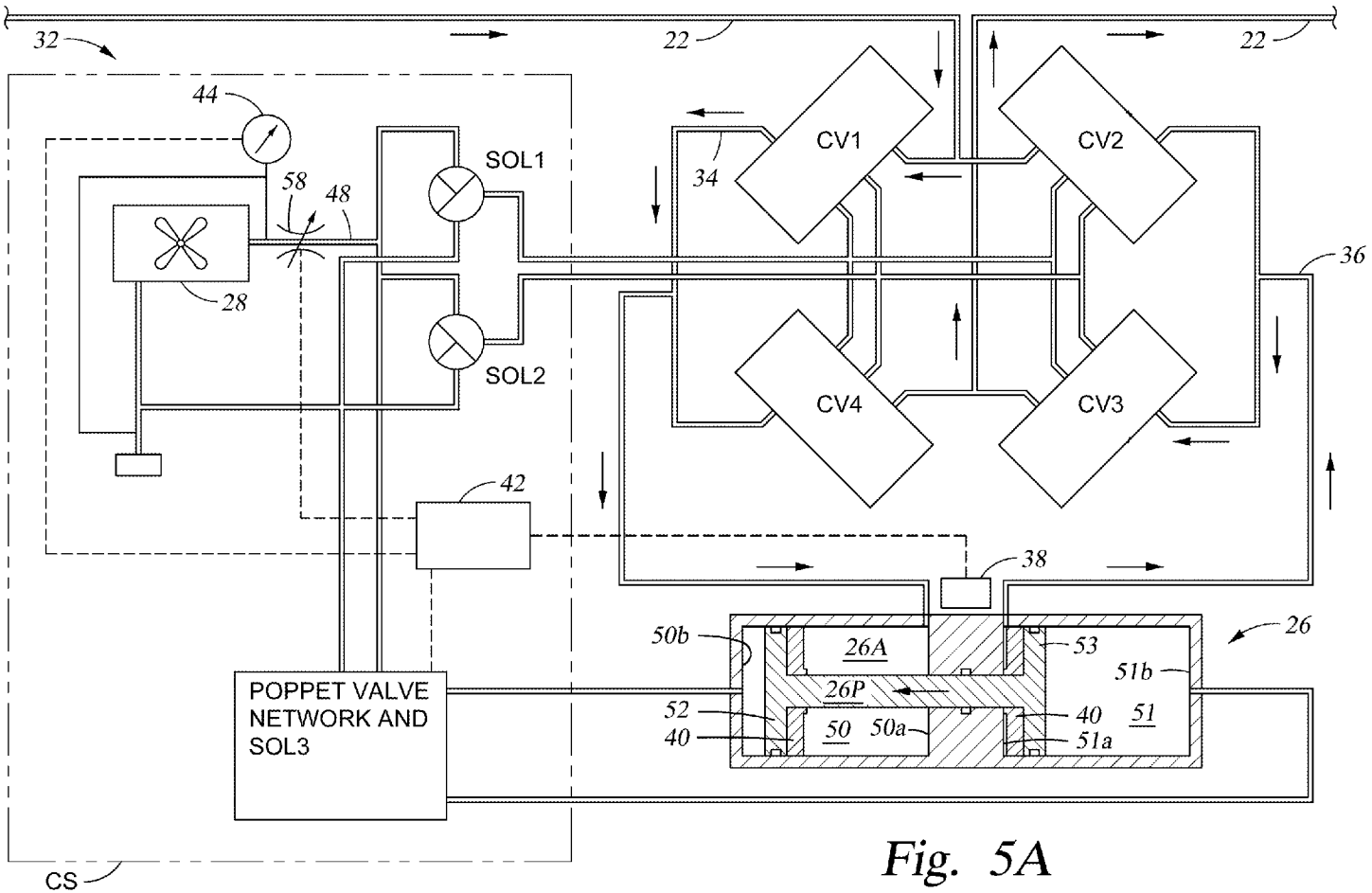
FIGS. 5A, 5B are schematic views of a fluid pumping module according to one or more aspects of the present disclosure.
Figure 5B:
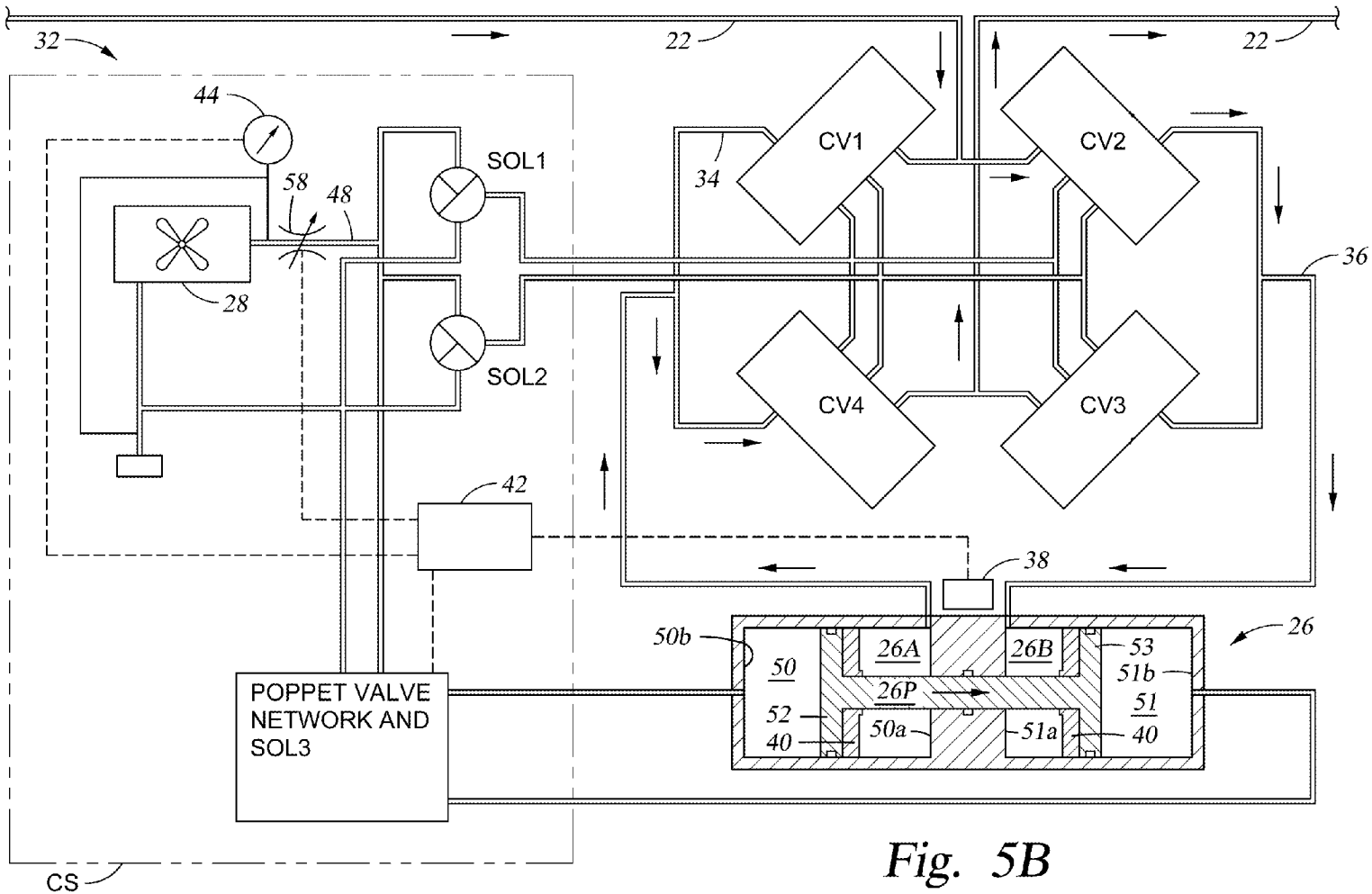

FIGS. 5A, 5B are schematic illustrations of a pump assembly 32 according to one or more aspects of the present disclosure. Pump assembly 32 depicted in FIGS. 4A, 4B is adapted to mitigate or dampen the shock (e.g., impact) of piston 26P reaching the end of its stroke (e.g., bottoming out). The dampening device depicted in FIGS. 5A, 5B includes an adjustable (e.g., variable) choke 58 hydraulically connected to hydraulic circuit 48 and operationally connected to electronic controller 42. As piston 26P approaches the end of a stroke, choke 58 (e.g., a dithering solenoid) is actuated to reduce the flow of hydraulic fluid in hydraulic circuit 48 thereby slowing the movement of piston 26P. Upon completing the stroke, the stroke direction may be reversed as described with reference to FIGS. 2A-3 for example. The position of piston 26P, relative to completing the stroke, may be determined via sensor 38 according to one or more aspects of the present disclosure. The threshold (e.g., position of piston 26P relative to the end of the stroke) for actuating dampening device 58 may be determined utilizing the pressure increase in hydraulic circuit 48 for example as measured by gauge 44.

A method, according to one or more aspects of the present disclosure, for operating a positive displacement pump of a downhole tool comprises supplying a hydraulic pressure to the pump to actuate a two-stroke piston to displace fluid at least partially through the downhole tool; moving the piston in a first stroke direction; and reversing the direction of the piston upon completion of the first stroke of the piston. Completion of a stroke may comprise a head of the piston substantially abutting an end wall of a chamber of the pump.

Reversing the direction of the piston may comprise monitoring the hydraulic pressure. Monitoring the hydraulic pressure may comprise measuring the hydraulic pressure in a hydraulic circuit between an energizing pump and the pump. Monitoring the hydraulic pressure may comprise measuring a characteristic of an energizing pump associated with the hydraulic pressure supplied. The direction of the piston is reversed in response to the hydraulic pressure achieving a threshold pressure.

The method may comprise reducing the speed of the piston as it approaches completion of the first stroke direction. Reducing the speed of the piston may comprise absorbing energy of the piston. Reducing the speed may comprise reducing the flow of a hydraulic fluid supplying the hydraulic pressure to the pump.

According to one or more aspects of the present disclosure, a pump assembly for pumping a fluid at least partially through a downhole tool comprises a two-stroke displacement unit including a piston having a first head positioned in a first cylinder and a second head positioned in a second cylinder; a first pump chamber formed between the first piston head and an end wall of the first cylinder; a second pump chamber formed between the second piston head and an end wall of the second cylinder; a control system providing hydraulic fluid via a hydraulic circuit to the displacement unit to move the piston in two stroke directions; and a dampening device connected with the displacement unit to reduce the speed of the piston as it approaches completion of the stroke.

The dampening device may comprise, for example, a choke hydraulically connected in the hydraulic circuit, wherein the choke is operable to reduce the flow of hydraulic fluid to the displacement unit. The dampening device may be positioned in at least one of the cylinders of the pump. For example, the dampening device may comprise a first dampening device disposed in the first cylinder between the first piston head and a distal wall of the first cylinder; and a second dampening device disposed in the second cylinder between the second piston head and a distal wall of the second cylinder.

A method for operating a pumping assembly of a downhole tool according to one or more aspects of the present disclosure comprises disposing a downhole tool having a pump assembly hydraulically connected to a flow line extending at least partially through the downhole tool in a borehole, the pump assembly comprising a two-stroke displacement unit including a piston having a first head positioned in a first cylinder and a second head positioned in a second cylinder; a first pump chamber formed between the first piston head and an end wall of the first cylinder; a second pump chamber formed between the second piston head and an end wall of the second cylinder; and a control system providing hydraulic fluid via a hydraulic circuit to the displacement unit to move the piston in two stroke directions in response to the hydraulic pressure of the hydraulic fluid; and reversing the direction of the piston stroke in response to the hydraulic pressure achieving a threshold pressure.

The threshold pressure may be associated with completion of the stroke, wherein completion of the stroke comprises substantially abutting one of the first and the second piston head with the respective end wall of the first chamber or the second chamber. The method may further comprise reducing the speed of the piston as it approaches completion of the stroke. Reducing the speed of the piston comprises reducing the flow of hydraulic fluid supplied to the displacement unit. The method may comprise absorbing energy from the piston as it approaches completion of the stroke.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

supplying a hydraulic pressure via a hydraulic fluid to a positive displacement pump of a downhole tool to actuate a two-stroke piston, having a first head positioned in a first cylinder and a second head positioned in a second cylinder, to displace other fluid at least partially through the downhole tool, wherein the first head divides the first cylinder into a first pump chamber and a first fluid chamber and wherein the second head divides the second cylinder into a second pump chamber and a second fluid chamber;

moving the piston in a first stroke direction by supplying the hydraulic fluid to the first pump chamber;

detecting a pressure increase caused by the piston abutting an inner wall of the first cylinder to foreclose a volume of the first fluid chamber;

actuating a valve, in response to detecting the pressure increase, to reverse the direction of the piston by supplying the hydraulic fluid to the second pump chamber.

2. The method of claim 1 wherein reversing the direction of the piston comprises monitoring the hydraulic pressure.

3. The method of claim 2 wherein monitoring the hydraulic pressure comprises measuring the hydraulic pressure in a hydraulic circuit between an energizing pump and the pump.

4. The method of claim 2 wherein monitoring the hydraulic pressure comprises at least one of measuring the hydraulic pressure in a hydraulic circuit between an energizing pump and the positive displacement pump and measuring a characteristic of the energizing pump associated with the hydraulic pressure supplied.

5. The method of claim 1 wherein the direction of the piston is reversed in response to the hydraulic pressure achieving a threshold pressure.

6. The method of claim 1 further comprising reducing the speed of the piston as it approaches completion of a stroke in the first stroke direction, wherein reducing the speed of the piston comprises absorbing energy of the piston by compressing a first dampening device detached from the piston and disposed in the second pump chamber.

7. The method of claim 1 further comprising reducing the speed of the piston as the piston approaches completion of a stroke in the first direction wherein reducing the speed comprises reducing the flow of a hydraulic fluid supplying the hydraulic pressure to the first pump chamber.

8. The method of claim 1 wherein reversing the direction of the piston comprises:

monitoring the hydraulic pressure supplied to the pump; and reversing the direction in response to achieving a threshold pressure in the hydraulic pressure.

9. The method of claim 8 wherein monitoring the hydraulic pressure comprises measuring the hydraulic pressure in a hydraulic circuit between an energizing pump and the pump.

10. The method of claim 8 wherein monitoring the hydraulic pressure comprises at least one of measuring the hydraulic pressure in a hydraulic circuit between an energizing pump and the pump and a characteristic of the energizing pump associated with the hydraulic pressure supplied.

11. The method of claim 1, wherein the piston blocks a fluid line to the first fluid chamber when abutting the inner wall of the first cylinder to foreclose the volume of the first fluid chamber.

12. An apparatus, comprising:

a pump assembly for pumping a fluid at least partially through a downhole tool, the assembly comprising:

a two-stroke displacement unit including a piston having a first piston head positioned in a first cylinder and a second piston head positioned in a second cylinder;

a first pump chamber formed between the first piston head and a distal wall of the first cylinder;

a second pump chamber formed between the second piston head and a distal wall of the second cylinder;

a first fluid chamber formed between the first piston head an inner wall of the first cylinder;

a second fluid chamber formed between the second piston head and an inner wall of the second cylinder;

a valve actuatable to reverse the direction of the piston;

a control system selectively providing hydraulic fluid via a hydraulic circuit to the first pump chamber to move the piston in a first stroke direction and to the second pump chamber to move the piston in an opposite stroke direction, wherein the control system is configured to actuate the valve to reverse the stroke direction in response to detecting a pressure increase caused by the first piston head abutting the inner wall of the first cylinder to foreclose a volume of the first fluid chamber; and a dampening device connected with the displacement unit to reduce the speed of the piston as it approaches completion of the stroke.

13. The apparatus of claim 12 comprising a sensor configured to detect a position of the first piston head within the first cylinder that indicates that the first piston head is approaching the inner wall of the first cylinder, wherein the control system is configured to actuate the dampening device in response to detecting the position, wherein the dampening device comprises a choke hydraulically connected in the hydraulic circuit, and wherein the choke is operable to reduce the flow of hydraulic fluid to the first pump chamber and the second pump chamber.

14. The apparatus of claim 12 wherein the dampening device is positioned in at least one of the cylinders of the pump.

15. The assembly of claim 12 wherein the dampening device comprises:

a first dampening device detached from the piston and disposed in the first pump chamber of the first cylinder between the first piston head and a distal wall of the first cylinder; and a second dampening device detached from the piston and disposed in the second pump chamber of the second cylinder between the second piston head and a distal wall of the second cylinder.

16. A method, comprising:

disposing a downhole tool having a pump assembly hydraulically connected to a flow line extending at least partially through the downhole tool in a borehole, the pump assembly comprising:

a two-stroke displacement unit including a piston having a first piston head positioned in a first cylinder and a second piston head positioned in a second cylinder;

a first pump chamber formed between the first piston head and a distal wall of the first cylinder;

a second pump chamber formed between the second piston head and a distal wall of the second cylinder;

a first fluid chamber formed between the first piston head an inner wall of the first cylinder;

a valve actuatable to reverse the direction of the piston; and a control system selectively providing hydraulic fluid via a hydraulic circuit to the first pump chamber to move the piston in a first stroke direction and to the second pump chamber to move the piston in an opposite stroke direction in response to the hydraulic pressure of the hydraulic fluid;

detecting a pressure increase caused by the first piston head abutting the inner wall of the first cylinder to foreclose a volume of the first fluid chamber; and actuating the valve, in response to detecting the pressure increase, to reverse the direction of the piston stroke.

17. The method of claim 16 wherein:

the method further comprises reducing the speed of the piston as it approaches completion of the stroke;

the threshold pressure is associated with completion of the stroke;

completion of the stroke comprises substantially abutting the first piston head with the inner wall of the first chamber;

reducing the speed of the piston comprises reducing the flow of hydraulic fluid supplied to the displacement unit; and the method further comprises absorbing energy from the piston as it approaches completion of the stroke.

18. The method of claim 16 wherein the method further comprises compressing, by the second piston head, a first dampening device detached from the piston and disposed in the second pump chamber to reduce the speed of the piston as the piston completes a stroke in the first stroke direction.

19. The method of claim 18 wherein the method further comprises compressing, by the first piston head, a second dampening device detached from the piston and disposed in the first pump chamber to reduce the speed of the piston as the piston completes a stroke in the opposite stroke direction.

20. The method of claim 16, wherein the first piston head blocks a fluid line to the first fluid chamber when abutting the inner wall of the first cylinder to foreclose the volume of the first fluid chamber.

* * * * *